United States Patent [19]

Gilles et al.

[11] Patent Number: 4,746,102

[45] Date of Patent: May 24, 1988

[54] DRAIN HOLE DESIGN FOR LADLE

[75] Inventors: Herbert L. Gilles, Macungie; Manfred Schmidt, Bethlehem; Alan W. Cramb, Pittsburgh, all of Pa.

[73] Assignee: Bethlehem Steel Corporation, Bethlehem, Pa.

[21] Appl. No.: 28,434

[22] Filed: Mar. 20, 1987

[51] Int. Cl.[4] ..... C21C 5/42

[52] U.S. Cl. ..... 266/236; 266/275

[58] Field of Search ..... 266/275, 236, 44; 222/591, 594, 600

[56] References Cited

U.S. PATENT DOCUMENTS 4,381,102 4/1983 King ..... 266/236

4,424,958 1/1984 Bachmann ..... 266/236

OTHER PUBLICATIONS

*The Making, Shaping and Treating of Steel,* U.S. Steel 10th edition, pp. 87–89, 12/85.

*Primary Examiner*—John P. Sheehan

*Assistant Examiner*—S. Kastler

*Attorney, Agent, or Firm*—John I. Iverson

[57] ABSTRACT

This invention is directed to a system for reducing the yield loss from a metallurgical vessel, such as a ladle holding liquid metal having a slag layer thereon, by delaying the onset of slag entrapment in the metal stream during the tapping thereof. More particularly, such system includes a modification to the drain hole and/or bottom of such vessel.

2 Claims, 2 Drawing Sheets

DRAIN HOLE DESIGN FOR LADLE

BACKGROUND OF THE INVENTION

In the refining of molten steel in a basic oxygen furnace (BOF) a slag blanket or covering is provided over the molten steel contained therein. The slag performs a multiplicity of functions in the refining process, such as scavenging undesirable elements from the molten steel and maintaining the high temperature of the steel.

When the molten steel is suitably refined and ready for tapping into a metallurgical vessel, such as a ladle, with the slag blanket remaining essentially on the free surface of the steel, the BOF vessel is tilted allowing the molten steel to exit through a taphole in the side of such vessel. A consequence of such tapping process is that a portion of the slag is transferred to the ladle. In fact, a certain amount of slag from the BOF was believed desirable to provide satisfactory insulation to the underlying molten steel in the ladle. However, quality requirements, such as desulfurized and very clean steels demand that only a limited amount of BOF slag enter the ladle. For example, the oxidized slag interferes with desulfurization. Thus, while it is important to control the amount of slag which is transferred to the ladle from the BOF, that which is transferred must eventually be separated from the molten steel.

In a typical practice followed today in the steel industry, the ladle is first filled with molten steel from the BOF until the slag layer above the steel is about 2 to 10" deep. An inert gas, such as argon, is then bubbled through the molten steel to homogenize it followed by a waiting period. Such procedure helps to free entrapped slag from the liquid steel and reestablish, or redefine, the slag-metal interface. The ladle is then drained into a tundish through a refractory pipe or shroud at a predetermined rate depending on the casting rate. The draining rate of the ladle is controlled with a slide gate valve at the bottom of the discharge orifice to maintain a constant steel level in the tundish. As the molten steel is drained from the ladle, the slag layer remains above the steel until the level of molten metal approaches the bottom of the ladle. The slag is then drawn down into the discharge stream and becomes entrapped in the steel. This causes unacceptable, impurities and surface defects in the final product. Consequently, draining of the ladle must be prematurely stopped, whereby the ladle is not completely drained and several tons of molten steel are lost in the process.

Through modeling studies on liquid flow using water and oil to simulate steel and slag, respectively, it has been observed that when liquid is drained from a hole in the bottom of a vessel, a vortex or a dip of the surface can occur above the drain hole. Vortexing, which starts with circulation of liquid in the vessel, can fully develops into the drain hole. The critical height, i.e., the height of the liquid where this fully developed vortex forms, increases with increasing outlet velocity and rotational flow or circulation in the vessel. It has also been observed through modeling studies, with or without the presence of a vortex, that near the end of drain the liquid slag layer collapses into the stream of liquid steel that is entering the drain hole. This mechanism is known as exceeding the limit of selective withdrawal, and the critical height or depth of heavier liquid at which this occurs is a function of the velocity of discharge, diameter of the discharge orifice, and density difference of the fluids.

From studies simulating draining of a ladle for continuous casting, the entrainment of slag is believed to be wholly caused by the collapse of the slag layer into the drain hole, or alternately, at the limit of selective withdrawal. Accordingly, a prime object of this invention is to significantly reduce the yield loss caused by collapse of the slag layer into the drain hole.

SUMMARY OF THE INVENTION

This invention relates to a system for reducing yield loss from any vessel holding liquid metal, such as a ladle, by delaying the onset of slag entrapment in the metal stream during teeming thereof. More specifically, such system incorporates the provision of a deep well drain hole, which may be characterized by (1) a funnel shape, (2) one or two concentric diameter wells, or (3) a deep well with a partial, inclined ladle bottom inclined toward said taphole.

DETAILED DESCRIPTION OF PREFERRED EMBODIMENT

This invention in its preferred embodiment, is directed to an improved ladle bottom configuration developed from extensive water modeling studies. In conducting steelmaking research, such as flow characteristics of molten steel in regard to metallurgical vessels, water modeling has become a safe and acceptable, and accurate tool for such research.

For example, it is now established that water is a convenient material to model molten steel since its kinematic viscosity (1.00 cs at 20° C.) is close to that of molten steel (0.91 cs at 1600° C.). However, for water modeling to be effective, the actual and model systems must be geometrically and dynamically similar. Geometric similarity is preserved when the ratio of any length in the model to the corresponding length in the actual system is the same everywhere. Dynamic similarity is preserved when the ratio of forces in the model is the same as in the actual system. The principal forces to be considered in the water modeling of steel ladle teeming are inertial, gravitational and viscous. Accordingly, for such studies leading to the development of this invention, such principal forces were considered and became an integral part of the research. In a corresponding manner, liquid slag can be simulated by using oil.

Figure 1:
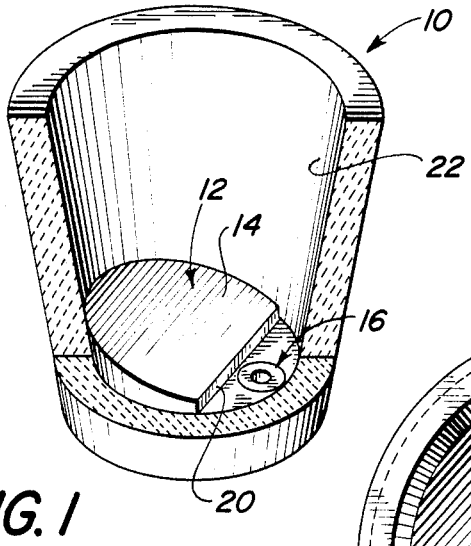
FIG. 1 is a simplified perspective of a metallurgical vessel, such as a ladle, showing one embodiment of a bottom modification thereto, in phantom, according to the teachings of this invention.

Turning now to the several FIGURES hereof, FIG. 1 shows a simplified perspective view of a ladle 10 modified to incorporate the bottom 12 configuration, a first embodiment according to this invention. Briefly, such bottom 12 is characterized by an inclined false bottom portion 14, inclined toward the drain hole 16.

Figure 2:
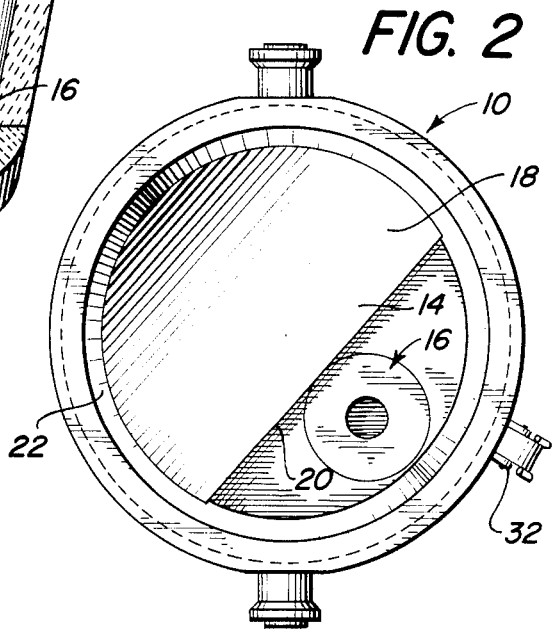
FIG. 2 is a detailed top view of a ladle for steel illustrating the modified bottom as shown in FIG. 1.
Figure 3:
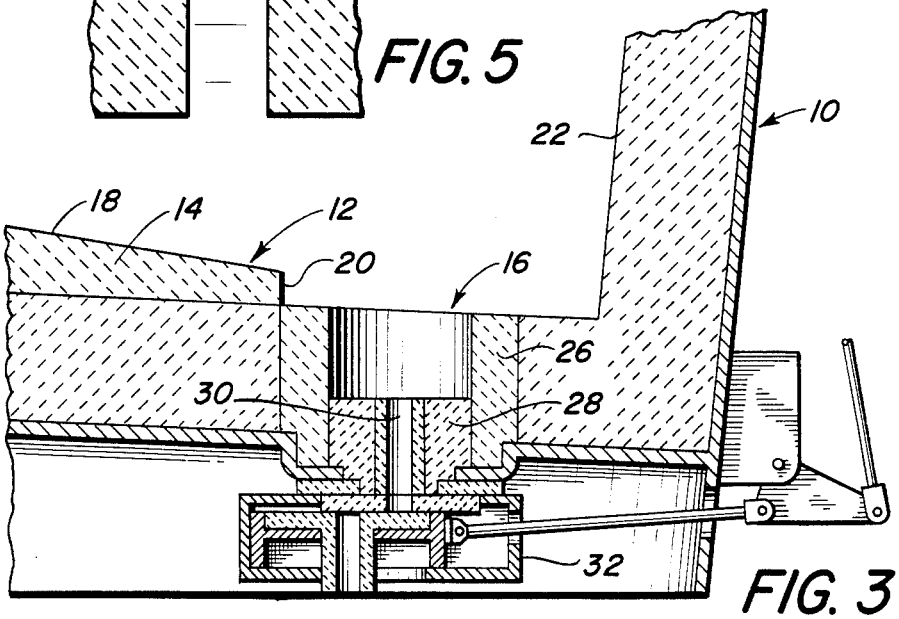
FIG. 3 is a partial sectional view of a ladle for steel showing in particular the modified drain hole design illustrated in FIG. 1, along with a conventional slide gate valve for terminating liquid flow from the ladle.

FIGS. 2 and 3, respectively, are a top view and partial sectional view of ladle 10 illustrating more details thereof, such as the deep well features of the drain hole 16. The false bottom portion 14 covering about two-thirds (⅔) of the ladle bottom 12, reveals a tapered upper surface 18, inclined at a slight angle of about 2°, and terminating at a vertical surface 20. Midway between said vertical surface 20 and the ladle wall 22, there is provided the drain hole generally shown as 16. The drain hole consists of two or more concentric portions 26, 28 decreasing in diameter from the upper drain hole 16 to the exit drain portion 30.

While the ladle closing mechanism does not form a part of this invention, there is shown in FIG. 3 a slide gate valve 32. Such mechanism, when activated in a lateral direction, will effectively stop the flow of molten metal through the drain hole. Such activation can be accomplished manually, or automatically by slag sensors disposed in the orifice of the exit drain hole 30. In either case, flow of molten metal is terminated when slag is detected in the metal stream. With conventional ladle designs, entrapment of the slag in the tap stream begins well before all the metal drains from the ladle. Such remaining steel in the ladle is thus lost to production. Commercial practices have shown that for a single 300 ton ladle such loss can be as much as nine (9) tons of steel, or about 3%.

Figures 4A, 4B, 4C:
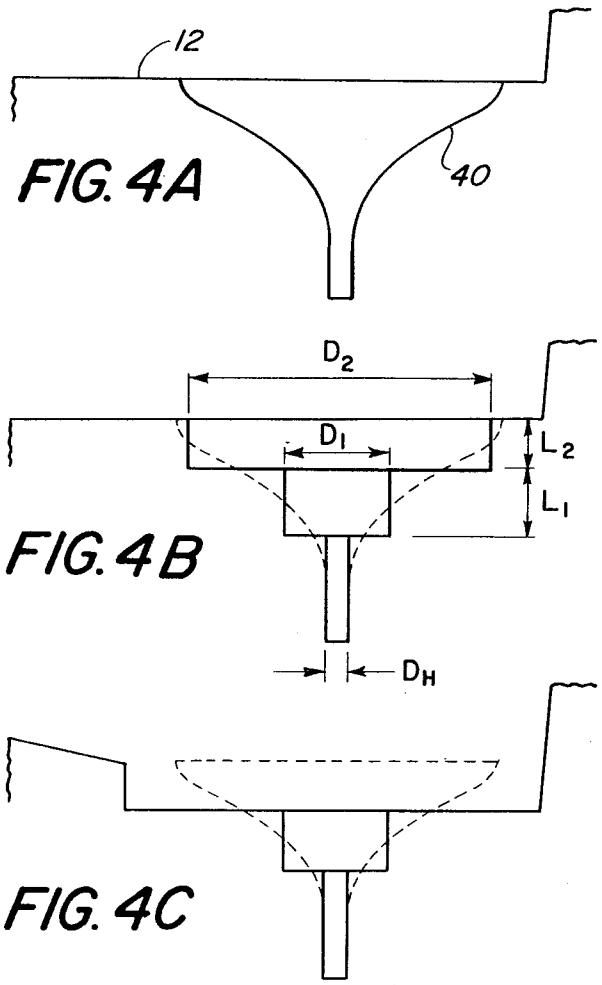
FIGS. 4A to 4C are simplified sectional profiles of three embodiments of the drain hole configuration according to the teachings of this invention.

FIGS. 4A to 4C are simplified views of further embodiments to the drain hole configurations according to this invention. The significance of such configurations will become more apparent in the discussion which follows. Briefly, FIG. 4A shows a funnel shape 40 opening up to the ladle bottom 12. Such configuration may be formed of a castable refractory or brick. FIGS. 4B and 4C represent simple alternatives to achieve the general configuration of FIG. 4A. The configuration of the latter two FIGURES may be formed by bricks to develop the concentric wells. For the configuration of FIG. 4C, i.e., a single deep well, to be most effective, it should be used with a sloped or false bottom, as discussed above. From a comparison of the various embodiments, the configuration of FIG. 4B appears to represent the optimum in minimizing retained steel in the ladle.

Before demonstrating the effectiveness of the bottom and drain hole configurations as described above, and as shown in the several FIGURES, it may be helpful to present some observations and theories in the ladle draining process. In the final phase of draining a liquid from a hole in the bottom of a vessel, two separate types of discharge mechanisms are observed: vortexing and selective withdrawal. Vortexing is a complex rotational movement which generates a vortex crater centered on the drain hole. The tangential velocities decrease with increasing distance from the core of the crater. A second phase material (e.g., slag) covering the liquid is, therefore, not moved away from the core by centrifugal forces but will move down into the crater where it can be entrained in the heavier liquid.

When vortexing does not occur or the vortex is not strong enough to cause entrainment of the lighter fluid, the heavier, lower fluid is drawn into the drain hole until a critical discharge is reached. At this condition, which is the limit of selective withdrawal, the upper liquid is in a state of incipient drawdown. A further decrease in the depth of the heavier liquid causes the layer of the lighter liquid above the drain hole to collapse and be drawn into the drain entrance. This mechanism may also cause draindown of the lighter fluid when a vortex is present.

Observations during the water modeling study showed that vortexing occurs at a much higher liquid bath depth than when the slag layer collapses at the limit of selective withdrawal. And, contrary to the general thinking in the steel industry, it was demonstrated that, although vortexing may be present, most entrainment occurs due to exceeding of the limit of selective withdrawal. Also, vortexing is more likely to occur when there is circulation or rotational motion of the fluid in a vessel. In a draining ladle, the fluid has time to stabilize and dissipate most of the major circulating energy gained in earlier processing steps, i.e., filling and gas stirring. Minor circulation due to convective thermal currents and flow unsymmetries caused by the vessel geometry may persist but do not cause strong vortex formation.

Figure 5:
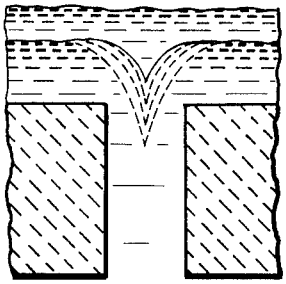
FIG. 5 is a simplified sectional view of a prior art (standard) drain hole simulating the collapse of the top layer (slag-oil) into the lower layer (steel-water).

Selective withdrawal ends when the heavier liquid reaches a minimum height above the bottom of the vessel for a specific minimum residual volume in the vessel. Drawing down of the lighter liquid is apparently due to a feeding problem whereby the flowing stream entering the drain hole sucks down lighter fluid immediately above as shown more clearly in FIG. 5.

It was discovered that by opening up the entrance to the drain hole the heavier fluid can more easily be pulled into the opening. Also, a wider entrance behaves like a second, much smaller vessel, i.e., selective withdrawal occurs more with respect to the depth of liquid in the entrance rather than with respect to the depth of the liquid in the vessel. Thus, a small volume replaces a large volume and when selective withdrawal occurs the volume remaining is generally that of the entrance rather than that of a large vessel. As a consequence, the end of selective withdrawal is delayed and the separation of metal from slag is improved.

Selective withdrawal ends when the heavier liquid reaches a certain level above the drain hole and this height is lowest when the liquid flow is undisturbed. Thus, a deep well at the drain entrance satisfies the two crucial requirements of undisturbed flow and minimum residual volume.

While several embodiments for the design of the drain hole have been illustrated in the various FIGURES, the optimum geometry of the drain entrance has the shape of a funnel with the large diameter at the top, FIG. 4A. Such a configuration, with the rounded upper rim, is beneficial to prevent flow instabilities that could cause vortex formation. However, this funnel shape is difficult to achieve with current refractory brick designs, but may be made of a castable refractory or brick. With presently available brick shapes, this funnel shape may be simulated by a plurality of concentric cylinders or wells, with the largest being on the top, the smallest above the drain hole, as shown in FIG. 4B.

To illustrate the effectiveness of the various drain hole designs, a comparison of geometries to improve separation and increase yield is shown in TABLE I.

TABLE I

Figures 4D, 4E, 4F:
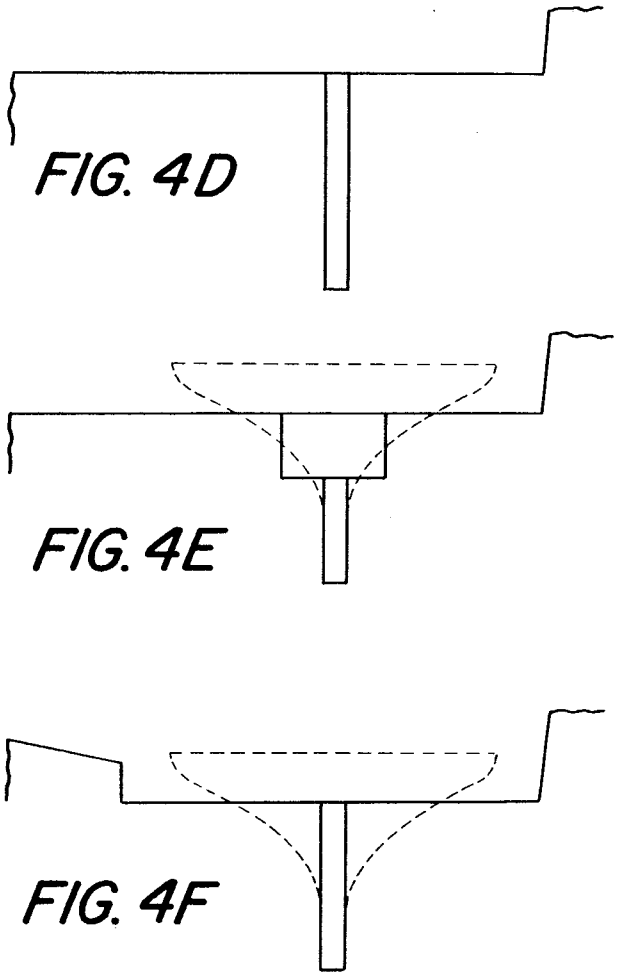
FIGS. 4D to 4F are simplified sectional profiles of a standard drain hole configuration, and two modifications thereof, respectively.

| Yield Loss In Ladle Based On Water Modeling | |
|---|---|
| Drain Hole Geometric Configuration | Weight (tons) of Steel Remaining in Ladle |
| 1. FIG. 4D Standard, Uniform Drain Hole | 9.0 |
| 2. FIG. 4E | 2.6 to 3.6 |
| 3. FIG. 4F False Bottom Only | 2.7 |
| 4. FIG. 4C | 1.1 to 1.3 |
| 5. FIG. 4B | 0.5 |

From the above data it is apparent that the optimum results are achieved with the double deep well configuration, as shown in FIG. 4B. As noted previously, such configuration closely simulates the funnel shape of FIG. 4A. To effect such simulation, there is a relationship between the depths and widths of the concentric portions. Based on water modeling studies, increasing from a minimum well depth, there is a linear relationship between well depth and well diameter. That is, with a given well diameter, one can observe a decreasing yield loss in steel with increasing well depth. Thus, for a given diameter well, the depth thereof should be no less than about 15%, preferably no less than about 25% of the diameter. From a preferred specific embodiment, insofar as it relates to the configuration of FIG. 4B, the following range of dimensions are offered:

$$\frac{D_1}{D_H} = 3 - 6$$

-continued $$\frac{D_2}{D_H} = 9 - 15$$

$$\frac{L_1}{D_H} = 1 - 4$$

$$\frac{L_2}{D_H} = 1 - 3$$

Where, as shown in FIG. 4B:

$D_H$=diameter of drain hole $D_1$=diameter of lower well $D_2$=diameter of upper well $L_1$=depth of lower well $L_2$=depth of upper well

We claim:

1. In a metallurgical ladle for holding molten metal having a layer of slag thereon, said ladle having a multi-diameter drain hole and a drain hole closing valve in the bottom for controlling the discharge of the molten metal, said multi-diameter drain hole having a small diameter discharge portion immediately above said closing valve, a medium diameter middle portion above and of a diameter 3–6 times greater than the diameter of said small diameter discharge portion, and a large diameter entry portion above said middle portion and of a diameter 9–15 times greater than the diameter of said small diameter discharge portion.

2. The metallurgical ladle of claim 1 in which the axial length of each of the three portions of said multidiameter drain hole has an axial length no less than 15% of the diameter of said portion.

* * * * *